US009341319B2

(12) United States Patent
Huang

(10) Patent No.: US 9,341,319 B2
(45) Date of Patent: May 17, 2016

(54) LAMP TUBE

(71) Applicant: LEXTAR ELECTRONICS CORPORATION, Hsinchu (TW)

(72) Inventor: Jiun-Shi Huang, Kaohsiung (TW)

(73) Assignee: Lextar Electronics Corporation, Hsinchu (TW)

( * ) Notice: Subject to any disclaimer, the term of this patent is extended or adjusted under 35 U.S.C. 154(b) by 120 days.

(21) Appl. No.: 14/340,480

(22) Filed: Jul. 24, 2014

(65) Prior Publication Data

US 2015/0146419 A1 May 28, 2015

(30) Foreign Application Priority Data

Nov. 22, 2013 (TW) ..... 102142576 A

(51) Int. Cl.
*F21V 7/00* (2006.01)
*F21K 99/00* (2016.01)
*F21V 21/22* (2006.01)

(52) U.S. Cl.
CPC . *F21K 9/175* (2013.01); *F21K 9/17* (2013.01); *F21V 7/00* (2013.01); *F21V 21/22* (2013.01)

(58) Field of Classification Search
CPC ..... F21K 9/17; F21K 9/175; F21V 21/22; F21V 7/00; F21V 7/005; F21V 7/0008; F21V 29/00; F21Y 2103/003
USPC ..... 362/217.01, 218, 249.02, 217.05
See application file for complete search history.

(56) References Cited

U.S. PATENT DOCUMENTS

| | | | | |
|---|---|---|---|---|
| 8,757,832 | B2 * | 6/2014 | Kim | F21K 9/17 362/217.01 |
| 8,807,784 | B2 * | 8/2014 | Marquardt | F21S 8/06 362/217.05 |
| 8,967,825 | B2 * | 3/2015 | Fukui | F21K 9/17 362/218 |
| 2011/0199767 | A1 * | 8/2011 | Marquardt | A47F 3/001 362/235 |
| 2012/0043884 | A1 * | 2/2012 | Lee | F21K 9/17 315/32 |
| 2012/0218757 | A1 * | 8/2012 | Gill | F21S 4/008 362/235 |
| 2013/0050998 | A1 * | 2/2013 | Chu | F21K 9/17 362/218 |

* cited by examiner

*Primary Examiner* — Sean Gramling
*Assistant Examiner* — Naomi M Wolford

(57) ABSTRACT

A lamp tube is provided, including a cover, a heat sink, a reflecting structure, a light bar, and a driving circuit. The cover is joined with the heat sink to form a tube body. The heat sink includes a first portion and a second portion symmetrical to a reference plane. The reflecting structure is disposed above the second portion, wherein the reflecting structure and the second portion of the heat sink define a receiving space with the driving circuit disposed therein. The light bar is disposed on the first portion of the heat sink.

13 Claims, 7 Drawing Sheets

LAMP TUBE

CROSS REFERENCE TO RELATED APPLICATIONS

The present application claims priority of Taiwan Patent Application No. 102142576, filed on Nov. 22, 2013, the entirety of which is incorporated by reference herein.

BACKGROUND OF THE INVENTION

1. Field of the Invention

The present application relates to a lamp tube, and in particular to a light-emitting diode (LED) lamp tube with a driving circuit inside.

2. Description of the Related Art

Currently, there are two types of light-emitting diode (LED) lamp tubes in common use: driver-inside lamp tubes and driver-outside lamp tubes. A driver-inside type lamp tube means that the driver is disposed inside the tube body. Alternatively, a driver-outside type lamp tube means that the driver is disposed outside the tube body.

FIG. 1 is a sectional view of a conventional driver-inside type lamp tube 10. The lamp tube 10 includes a cover 10*a* made of plastic, a heat sink 10*b* made of aluminum, a driving circuit 10*c*, and a light bar including a circuit board 10*d* and at least a light-emitting element 10*e*, such as an LED. The driving circuit 10*c* is disposed in a receiving space R of the heat sink 10*b*, and the light bar is disposed above the driving circuit 10*c* and the heat sink 10*b*.

However, the receiving space R of the heat sink 10*b* is about half the volume of the entire lamp tube 10, thus the light-mixing distance D1 from the light-emitting element 10*e* to the cover 10*a* is reduced. Consequently, it is usually required that more LEDs be used for improving the illumination of the lamp tube 10, such that the production cost is increased. It should be noted that the heat generated by the light bar and the driving circuit 10*c* is mainly dissipated through the heat sink 10*b*. However, since the light bar in the traditional lamp tube 10 is stacked on the driving circuit 10*c*, the heat from the light bar does not easily dissipate. Therefore, the operation temperature of the driving circuit 10*c* may increase, such that the usage life of the lamp tube 10 is reduced. For the reasons described above, a driver-inside LED lamp tube which can have great illumination and efficiently dissipate heat from the light bar and the driving circuit 10*c* is needed.

BRIEF SUMMARY OF THE INVENTION

An embodiment of the invention provides a lamp tube, comprising a cover, a heat sink, a reflecting structure, a light bar, and a driving circuit. The heat sink is joined with the cover to form a tube body that extends along a first direction, wherein the heat sink includes a first portion and a second portion substantially symmetrical to a reference plane that is parallel to the first direction and intersects both the cover and the heat sink. The reflecting structure is disposed above the second portion of the heat sink and comprises a reflecting surface, a first extended wall, and a second extended wall. The reflecting surface is tilted with respect to the reference plane at a first angle. The first extended wall is connected to a joint between the first and second portions, and the second extended wall is connected to an edge of the second portion that is distant from the first portion. The reflecting structure and the second portion of the heat sink define a receiving space with the driving circuit therein. The light bar is disposed on the first portion of the heat sink, wherein a normal line of the light bar is tilted with respect to the reference plane at a second angle.

In another embodiment, the cover includes a first connection portion and a second connection portion formed on two sides of the cover that are parallel to the first direction, and the first and second connection portions are symmetrical to the reference plane. The heat sink further includes a first side portion and second side portion formed on two sides of the heat sink that are parallel to the first direction, and the first and second side portions are symmetrical to the reference plane. The first connection portion is engaged with the first side portion, and the second connection portion is engaged with the second side portion.

In another embodiment, the first and second connection portions respectively include a first recess and a second recess, and the first and second side portions respectively include a first hook and a second hook.

In another embodiment, the heat sink further includes a first protrusion extended from the first side portion, and a first guiding channel is formed between the first protrusion and the inner surface of the first portion of the heat sink.

In another embodiment, the first extended wall of the reflecting structure is tilted with respect to the reference plane, and a second guiding channel is formed between the first extended wall and the inner surface of the first portion of the heat sink, wherein the light bar is restricted in the first and second guiding channels.

In another embodiment, the heat sink further includes a second protrusion extended from the inner surface of the first portion and abutting the light bar.

In another embodiment, the reflecting surface is formed by a reflective film, reflective paint, or reflective sticker.

In another embodiment, the reflecting structure and the heat sink are integrally formed in one piece.

In another embodiment, the heat sink further includes a substantially semicircular surface.

In another embodiment, the light bar includes a circuit board with a plurality of light-emitting elements disposed thereon.

In another embodiment, the light-emitting elements are light-emitting diodes.

In another embodiment, the lamp tube further comprises two end caps covering two opposite ends of the tube body.

In another embodiment, the first angle is between 0 and 90 degrees, and the second angle is between 30 and 145 degrees.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
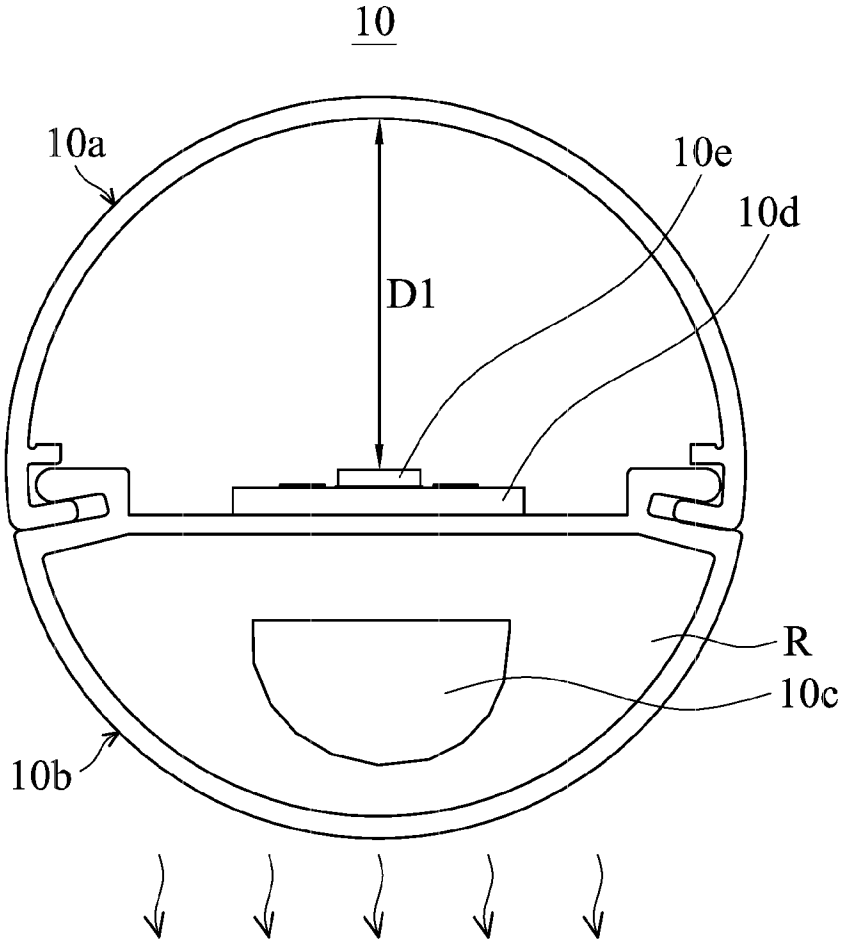
FIG. 1 ( PRIOR ART )
FIG. 1 is a sectional view of a conventional driver-inside type lamp tube.
Figure 2A:
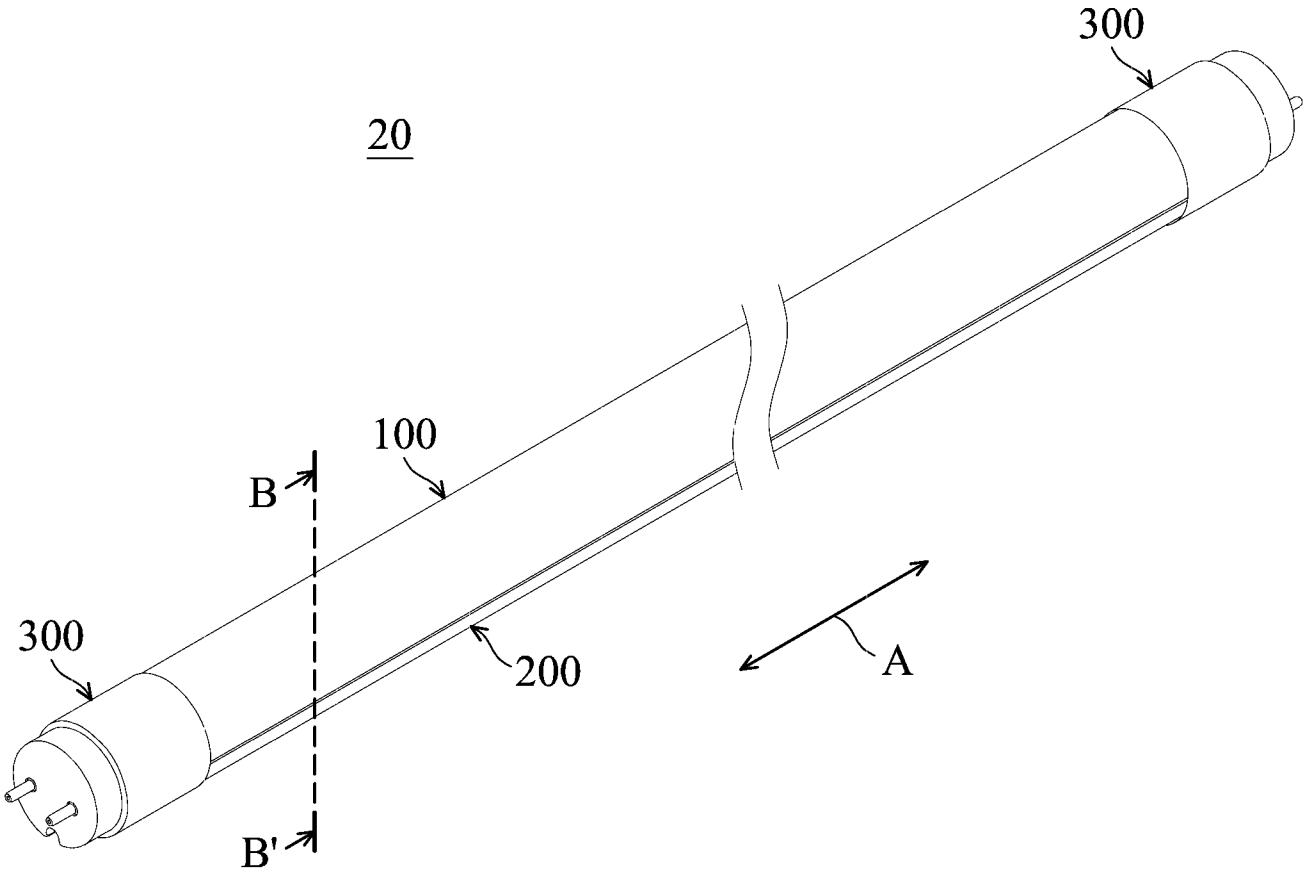
FIG. 2A is a perspective view of a lamp tube according to an embodiment of the invention.
Figure 2B:
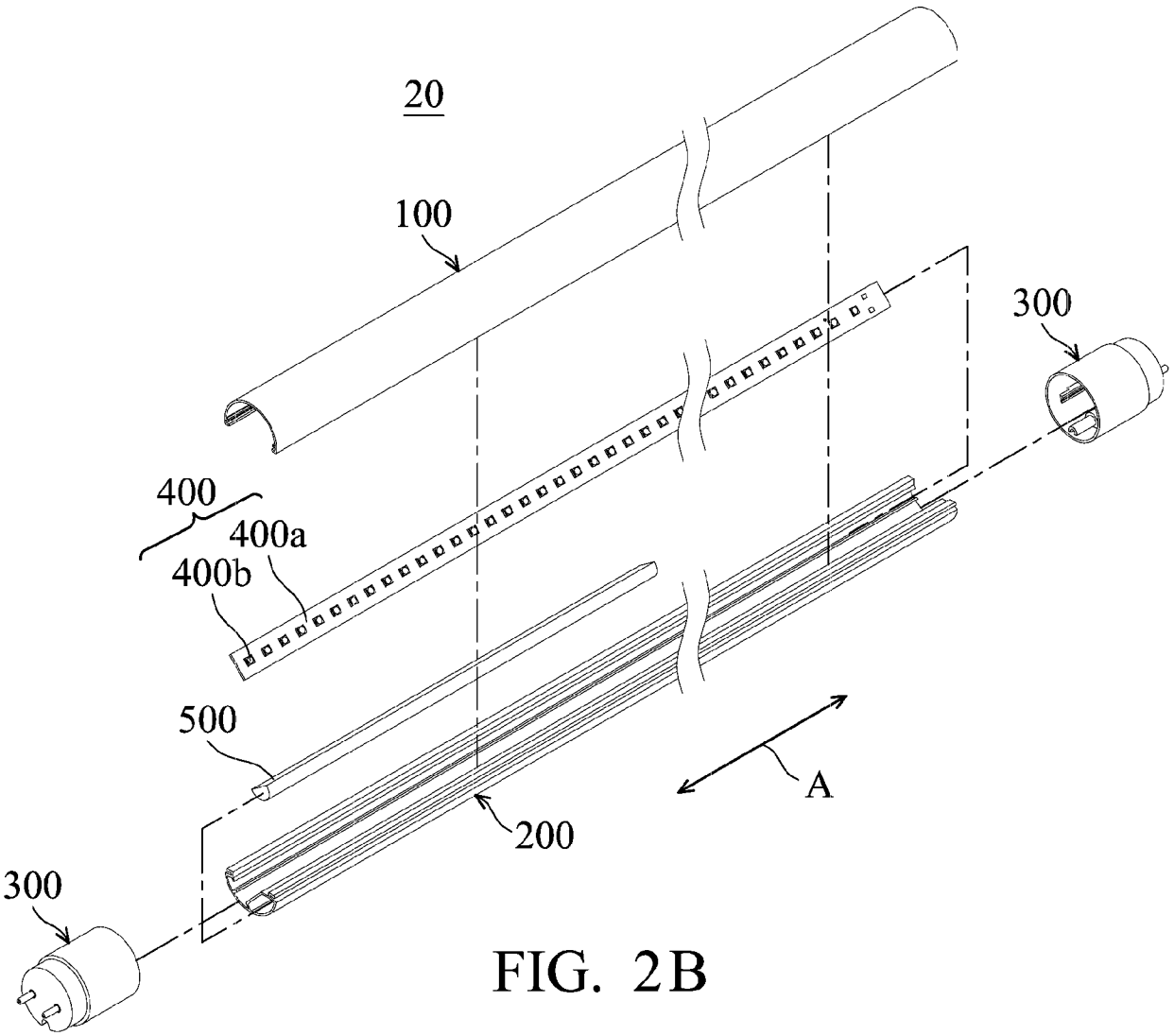
FIG. 2B is an exploded view of the lamp tube in FIG. 2A.

FIG. 2A and FIG. 2B are a perspective view and an exploded view of a lamp tube 20 according to an embodiment of the invention. The lamp tube 20 includes a cover 100, a heat sink 200, two end caps 300, a light bar 400, and a driving circuit 500.

In this embodiment, the cover 100 comprises plastic, and the heat sink 200 comprises aluminum. The cover 100 is joined with the heat sink 200 to form a tube body that extends along a first direction A. Two opposite ends of the tube body are covered by the two end caps 300, respectively, wherein each of the end caps 300 has conductive pins electrically connected to light bar 400 and the driving circuit 500 through electrical wires (not shown in FIGS. 2A and 2B). The light bar 400 includes a longitudinal circuit board 400*a* with several light-emitting elements 400*b* arranged along the longitudinal axis thereof, wherein the light-emitting elements 400*b* may be light-emitting diodes (LED). It should be noted that the light bar 400 and the driving circuit 500 of this embodiment are disposed in different positions in the heat sink 200, as illustrated in the drawings FIG. 3 and FIG. 4A.

Figure 3:
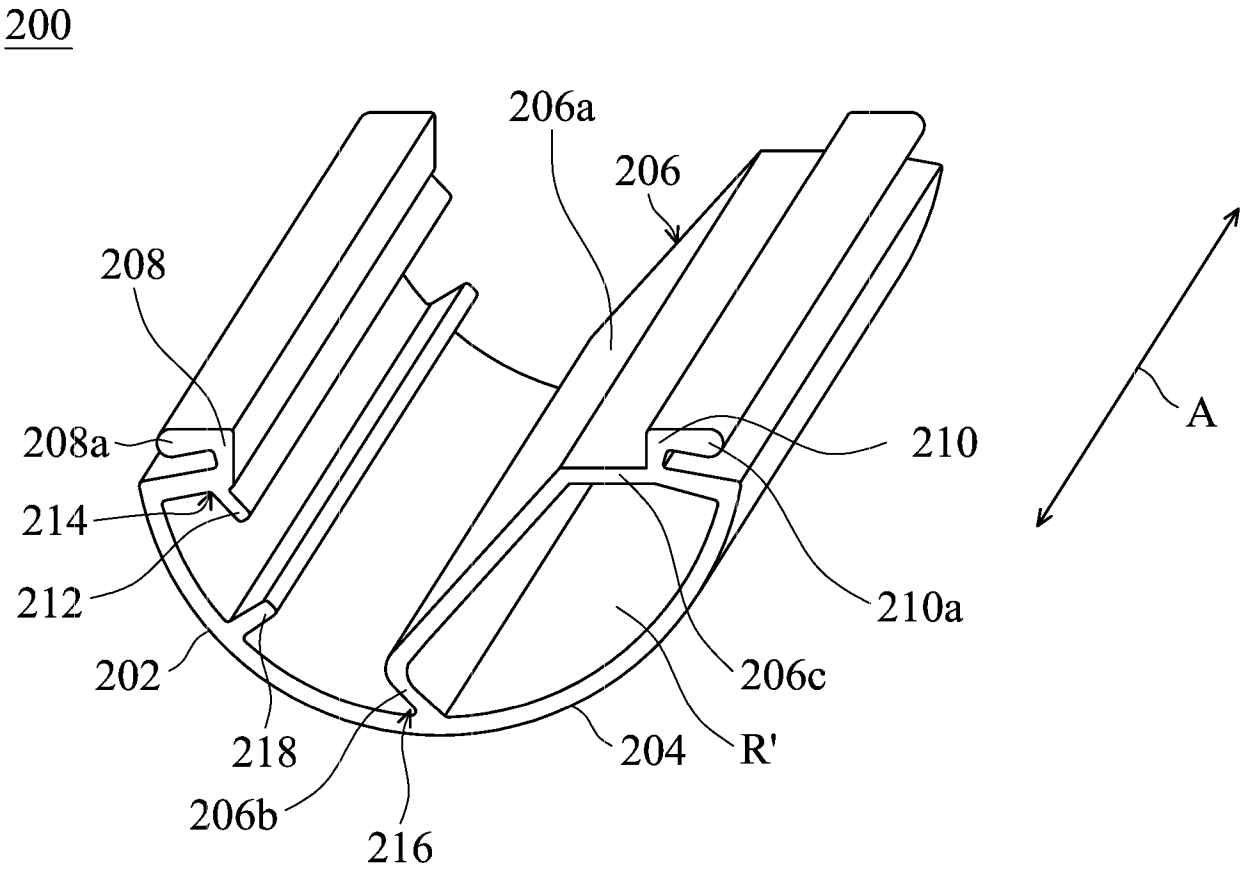
FIG. 3 is a schematic view of the heat sink in FIGS. 2A and 2B.
Figure 4A:
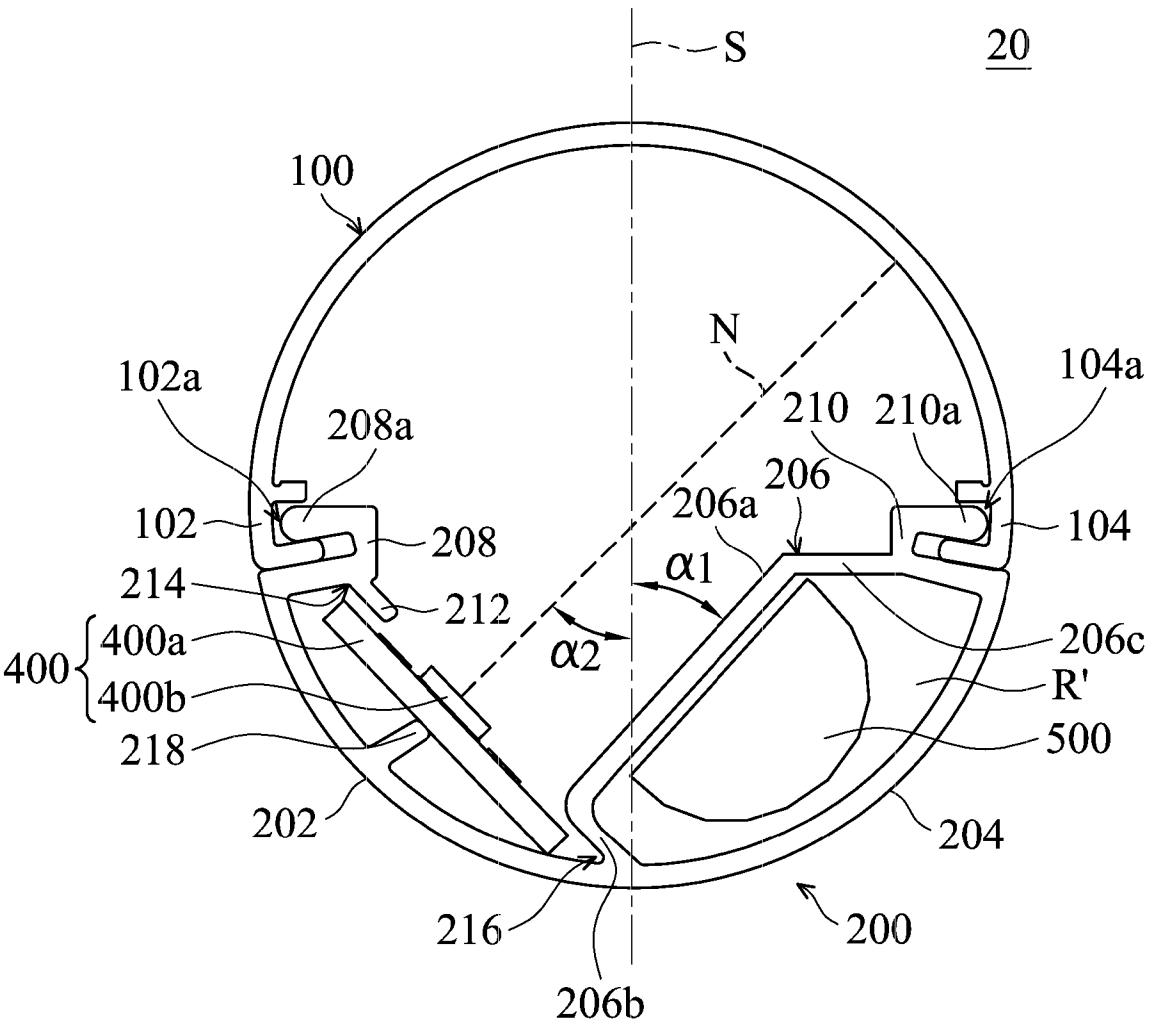
FIG. 4A is a sectional view taken along the line B-B' of FIG. 2A.

FIG. 3 and FIG. 4A are a perspective view of the heat sink 200 and a schematic view of the lamp tube 20. In this embodiment, the heat sink 200 has a substantially semicircular surface, and includes a first portion 202 and a second portion 204 substantially symmetrical to a reference plane S which is a virtual plane. The reference plane S is parallel to the first direction A (FIG. 2A) and intersects both the cover 100 and the heat sink 200.

The heat sink 200 further has a reflecting structure 206 formed above the second portion 204 of the heat sink 200, wherein the reflecting structure 206 and the second portion 204 define a receiving space R'. In this embodiment, the reflecting structure 206 and the heat sink 200 are integrally formed in one piece. The reflecting structure 206 includes a reflecting surface 206*a*, a first extended wall 206*b*, and a second extended wall 206*c*. The first extended wall 206*b* is connected to a joint between the first and second portions 202 and 204. The second extended wall 206*c* is connected to an edge of the second portion 204 that is distant from the first portion 202. The driving circuit 500 of this embodiment is disposed in the receiving space R'.

Still referring to FIG. 3 and FIG. 4A, the heat sink 200 further includes a first side portion 208 and a second side portion 210 respectively formed on two sides of the heat sink 200 that are parallel to the first direction A. The first and second side portions 208 and 210 are symmetrical to the reference plane S and respectively include a first hook 208*a* and a second hook 210*a*. Moreover, the cover 100 further includes a first connection portion 102 and a second connection portion 104 formed on two sides of the cover 100 that are parallel to the first direction A. The first and second connection portions 102 and 104 are symmetrical to the reference plane S and respectively include a first recess 102*a* and a second recess 104*a*. By engaging the first recess 102*a* of the first connection portion 102 with the first hook 208*a* of the first side portion 208, and engaging the second recess 104*a* of the second connection portion 104 with the second hook 210*a* of the second side portion 210, the cover 100 and the heat sink 200 are fixed to each other to form the tube body.

In this embodiment, the heat sink 200 further includes a first protrusion 212 extended from the first side portion 208. Specifically, a first guiding channel 214 is formed between the first protrusion 212 and the inner surface of the first portion 202 of the heat sink 200. As shown in FIG. 4A, the reflecting surface 206*a* of the reflecting structure 206 is tilted with respect to the reference plane S at a first angle $\alpha 1$, wherein the first angle $\alpha 1$ is between 0 and 90 degrees. Furthermore, the first extended wall 206*b* of the reflecting structure 206 is tilted with respect to the reference plane S, and a second guiding channel 216 is formed between the first extended wall 206*b* and the inner surface of the first portion 202 of the heat sink 200. Therefore, the light bar 400 can be inserted along and restricted in the first and second guiding channels 214 and 216 (FIG. 4A). In this embodiment, the heat sink 200 further includes a second protrusion 218 extended from the inner surface of the first portion 202. The second protrusion 218 abuts the circuit board 400*a* of the light bar 400 to facilitate rapid heat dissipation of the light bar 400.

Figure 4B:
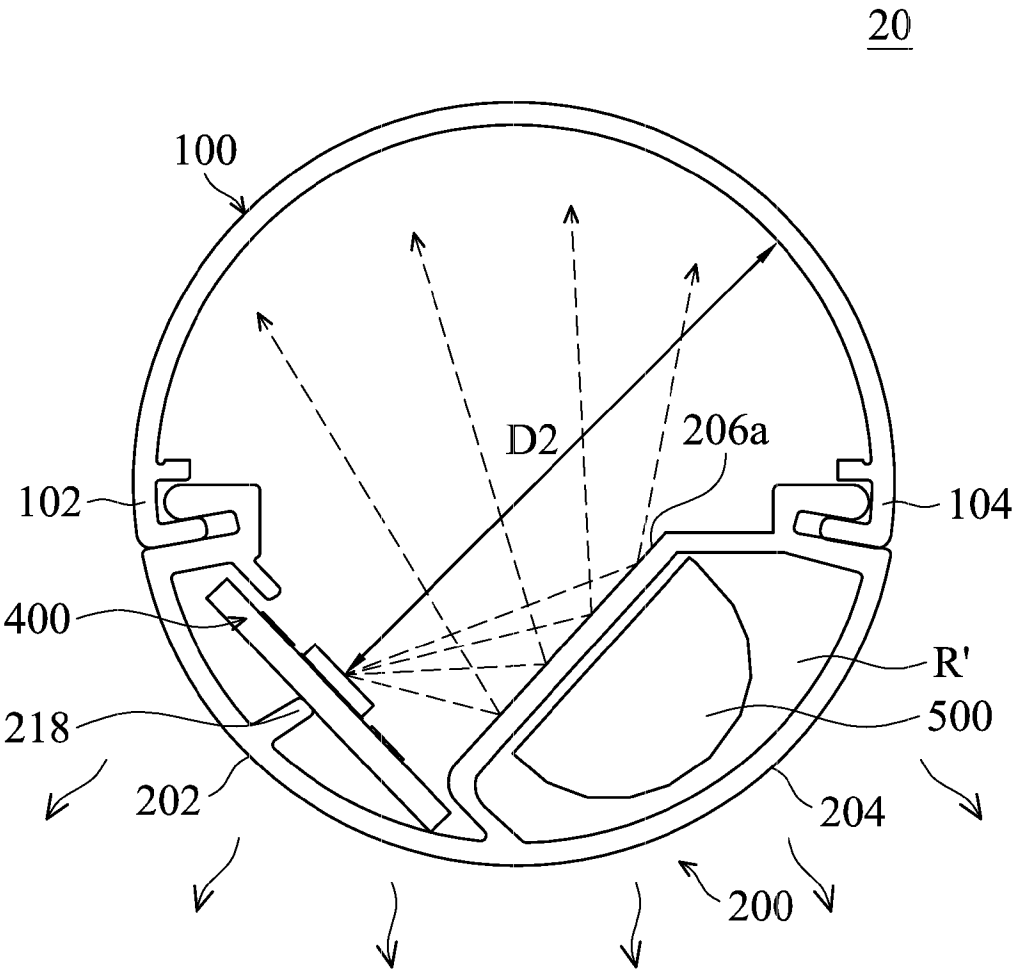
FIG. 4B is a sectional view illustrating the light from the light bar 400 reflected by the reflecting surface 206*a* to the cover 100.

Referring to FIG. 4A and FIG. 4B, the light bar 400 of this embodiment is disposed on the first portion 202 of the heat sink 200, and the driving circuit 500 is disposed in the receiving space R' above the second portion 204 of the heat sink 200. Accordingly, the heat generated from the light bar 400 and the driving circuit 500 will not be collected together and can be dissipated through the first and second portions 202 and 204, respectively. Additionally, the normal line N of the light bar 400 is tilted with respect to the reference plane S at a second angle $\alpha 2$, wherein the second angle $\alpha 2$ is about 45 degrees (FIG. 4A). With these structural features, a light-mixing distance D2 from the light-emitting elements 400*b* of the light bar 400 to the cover 100 is increased, thus improving the illumination efficiency of the lamp tube 20. In this embodiment, the reflecting surface 206*a* of the reflecting structure 206 may be formed by a reflective film, reflective paint, or reflective sticker, such that the light from the light-emitting elements 400 can be reflected by the reflecting surface 206*a* to concentrate on the center of the cover 100 (FIG. 4B).

Figure 4C:
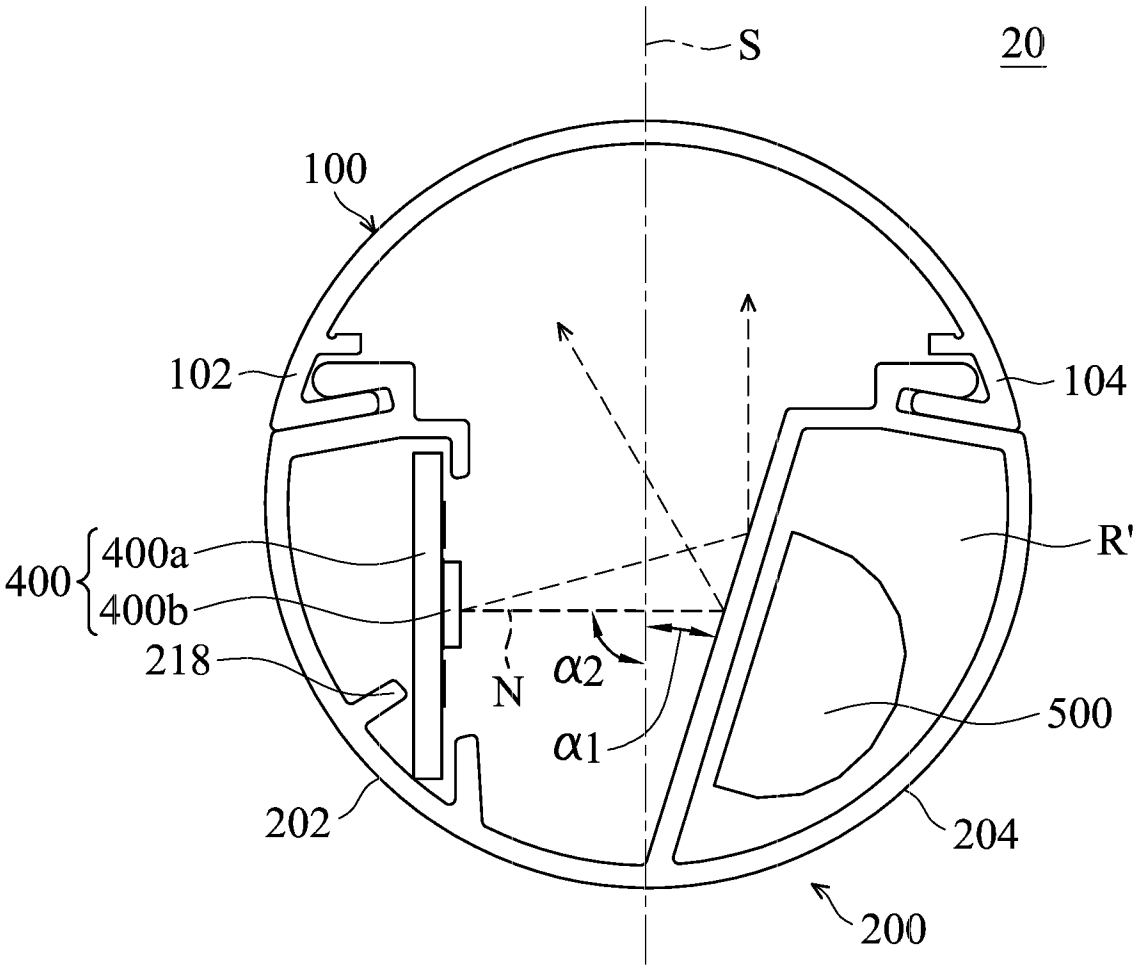
FIG. 4C is a sectional view of a lamp tube according to another embodiment of the invention.

In some embodiments, the second angle $\alpha 2$ may be between 30 and 145 degrees. It should be noted that the second angle $\alpha 2$ is determined according to the tilted angle between the reflecting surface 206*a* and the reference plane S (i.e. the first angle $\alpha 1$). Therefore, the light from the light-emitting elements 400*b* can also be concentrated on the center of the cover 100. FIG. 4C is a sectional view of a lamp tube according to another embodiment of the invention, wherein the second angle $\alpha 2$ is about 90 degrees.

As described above, the invention provides a driver-inside type LED lamp tube, in which the heat generated from the light bar and the driving circuit can be efficiently dissipated by the light bar and the driving circuit separately disposed above the first and second portions of the heat sink. With the mechanism of the heat sink, the light-mixing distance from the light-emitting elements to the cover is also increased. Consequently, the usage life of the lamp tube can be extended and the illumination efficiency thereof can be improved.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lamp tube, comprising:

a cover;

a heat sink, joined with the cover to form a tube body extended along a first direction, wherein the heat sink includes a first portion and a second portion substantially symmetrical to a reference plane that is parallel to the first direction and intersects both the cover and the heat sink;

a reflecting structure, disposed above the second portion of the heat sink, comprising:

a reflecting surface, tilted with respect to the reference plane at a first angle;

a first extended wall, connected to a joint between the first and second portions; and a second extended wall, connected to an edge of the second portion that is distant from the first portion;

wherein the reflecting structure and the second portion of the heat sink define a receiving space;

a light bar, disposed on the first portion of the heat sink, wherein a normal line of the light bar is tilted with respect to the reference plane at a second angle; and a driving circuit, disposed in the receiving space.

2. The lamp tube as claimed in claim 1, wherein the cover includes a first connection portion and a second connection portion formed on two sides of the cover that are parallel to the first direction, and the first and second connection portions are symmetrical to the reference plane, wherein the heat sink further includes a first side portion and second side portion formed on two sides of the heat sink that are parallel to the first direction, and the first and second side portions are symmetrical to the reference plane, wherein the first connection portion is engaged with the first side portion, and the second connection portion is engaged with the second side portion.

3. The lamp tube as claimed in claim 2, wherein the first and second connection portions respectively include a first recess and a second recess, and the first and second side portions respectively include a first hook and a second hook.

4. The lamp tube as claimed in claim 3, wherein the heat sink further includes a first protrusion extended from the first side portion, and a first guiding channel is formed between the first protrusion and the inner surface of the first portion of the heat sink.

5. The lamp tube as claimed in claim 4, wherein the first extended wall of the reflecting structure is tilted with respect to the reference plane, and a second guiding channel is formed between the first extended wall and the inner surface of the first portion of the heat sink, wherein the light bar is restricted in the first and second guiding channels.

6. The lamp tube as claimed in claim 5, wherein the heat sink further includes a second protrusion extended from the inner surface of the first portion and abutting the light bar.

7. The lamp tube as claimed in claim 1, wherein the reflecting surface is formed by a reflective film, reflective paint, or reflective sticker.

8. The lamp tube as claimed in claim 1, wherein the reflecting structure and the heat sink are integrally formed in one piece.

9. The lamp tube as claimed in claim 1, wherein the heat sink further includes a substantially semicircular surface.

10. The lamp tube as claimed in claim 1, wherein the light bar includes a circuit board with a plurality of light-emitting elements disposed thereon.

11. The lamp tube as claimed in claim 10, wherein the light-emitting elements are light-emitting diodes.

12. The lamp tube as claimed in claim 11, further comprising two end caps covering two opposite ends of the tube body.

13. The lamp tube as claimed in claim 1, wherein the first angle is between 0 and 90 degrees, and the second angle is between 30 and 145 degrees.

* * * * *